US007387199B2

(12) United States Patent
Cheng et al.

(10) Patent No.: US 7,387,199 B2
(45) Date of Patent: Jun. 17, 2008

(54) DEVICE OF HANDLING ROLLER FOR PASSBOOK

(75) Inventors: Hui Cheng, Hitachinaka (JP); Kazushi Yoshida, Kasumigaura (JP); Tatsuma Suzuki, Tajimi (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 0 days.

(21) Appl. No.: 11/528,311

(22) Filed: Sep. 28, 2006

(65) Prior Publication Data

US 2007/0194522 A1 Aug. 23, 2007

(30) Foreign Application Priority Data

Feb. 17, 2006 (JP) ..... 2006-040446

(51) Int. Cl.
*B65G 13/06* (2006.01)

(52) U.S. Cl. ..... 198/781.02; 193/37

(58) Field of Classification Search ..... 193/35 R, 193/37; 198/780, 781.02, 608
See application file for complete search history.

(56) References Cited

U.S. PATENT DOCUMENTS 4,385,683 A * 5/1983 Krupp ..... 193/37
4,495,683 A * 1/1985 Delhaes ..... 193/37
4,664,252 A * 5/1987 Galbraith ..... 198/780
5,960,931 A * 10/1999 Nilsson ..... 193/37
6,935,486 B2 * 8/2005 Davis ..... 198/781.02
7,090,065 B2 * 8/2006 Whipple et al. ..... 193/37

FOREIGN PATENT DOCUMENTS

JP 06-316346 11/1994

* cited by examiner

*Primary Examiner*—James R Bidwell
(74) *Attorney, Agent, or Firm*—Antonelli, Terry, Stout & Kraus, LLP.

(57) ABSTRACT

A passbook conveyance roller device comprises a conveyance roller and a pinch roller, which are arranged to be opposed to each other, to convey a passbook. The conveyance roller comprises an inner ring member connected to a drive shaft, a metallic outer ring member, and a rubber member fixed to, for example, an outer peripheral surface of the inner ring member and press fitted into an inner peripheral surface of the outer ring member to give elastic forces to the inner peripheral surface of the outer ring member in a plurality of positions, which are spaced circumferentially at predetermined intervals from one another and arranged in point symmetry. Both the inner ring member and the outer ring member are rotated through the elastic member when a load torque on the outer ring member is less than a set torque set by the elastic forces of the rubber member. Relative slip is generated between the inner peripheral surface of the outer ring member and the rubber member when a load torque on the outer ring member is equal to or larger than the set torque.

6 Claims, 5 Drawing Sheets

DEVICE OF HANDLING ROLLER FOR PASSBOOK

BACKGROUND OF THE INVENTION

The present invention relates to a passbook conveyance roller device, in which a passbook-like article is conveyed by a conveyance roller and a pinch roller, which are arranged to be opposed to each other.

A passbook printer provided in, for example, automatic teller machines and passbook handling devices comprises: for example, an entrance and leaving port, through which a user inserts or takes out a passbook; a conveyance roller mechanism provided on a passbook handling path, which extends from the entrance and leaving port; a magnetic stripe read mechanism that reads information of magnetic stripes stuck to a cover of the passbook; an ink jet type printing mechanism, for example, that prints on the passbook on the basis of information read by the magnetic stripe read mechanism; and a page (paper) veerer that turns over a printed page of the passbook. The conveyance roller mechanism comprises a plurality of rows of conveyance rollers and pinch rollers, which are arranged to be opposed to each other, and conveys a passbook to positions of the magnetic stripe read mechanism, the printing mechanism, and the page veerer in response to a command from a control circuit.

By the way, there is disclosed a conveyance roller mechanism provided on a sheet conveyance path of an electrophotographic copier, in which a conveyance roller (drive roller) has a torque limiter function (see, for example, JP-A-6-316346). The conveyance roller comprises a core member made of a resin, fixed on a drive shaft, and formed on an outer peripheral surface thereof with irregularities, and a rubber roller member having a smaller hole than an outside diameter of the core member, the core member being press fitted into the hole of the rubber roller member to be made integral therewith. Thereby, a set torque of the torque limiter function is set by a frictional force generated between the outer peripheral surface of the core member and an inner peripheral surface of the rubber roller member. In the case where, for example, conveyance rollers on an upstream side are set to be smaller in rotational speed than conveyance rollers on a downstream side, the downstream conveyance rollers have the torque limiter function. Thereby, when a conveyed sheet is influenced by the upstream conveyance rollers, the downstream conveyance rollers are put in a state, in which rubber roller members thereof slide relative to core members thereof, to maintain low-speed conveyance, and when a conveyed sheet is not influenced by the upstream conveyance rollers, the downstream conveyance rollers make high-speed conveyance.

The conveyance roller mechanism of the passbook printer is not only required to be heightened in conveyance accuracy, with which printing is made on a passbook, but also must make conveyance in accordance with a change in thickness of printed pages of the passbook. That is, when, for example, the conveyance rollers and the pinch rollers are low in coefficient of friction and pinch force, there is a possibility that slip occurs between a roller and a passbook and a passbook cannot get over a sheet number step caused by a difference between the number of sheets on a cover side of the passbook and the number of sheets on a back cover side thereof and a spine step of a stitched portion. Therefore, it is generally requested to heighten conveyance rollers and pinch rollers in coefficient of friction and pinch force. When conveyance rollers and pinch rollers are heightened in coefficient of friction and pinch force, however, there occurs a possibility that a roller digs a paper surface of a passbook, for example, when jam of the passbook happens to occur. In particular, there is a possibility of damage since a medium, such as a passbook, being thick is hard to buckle.

Hereupon, it is assumed that conveyance rollers having the torque limiter function described above are applied to a conveyance roller mechanism of a passbook printer. Thereby, it is thought that damage to a passbook can be prevented when jam occurs. Since conventional conveyance rollers comprise a rubber roller member, however, there is a possibility that printing ink is transferred (primary transfer to a roller and secondary transfer to a passbook) unlike metallic conveyance rollers when a pinch force is increased with a view to an improvement in conveyance accuracy. Also, with conventional conveyance rollers, irregularities formed on an outer peripheral surface of a core member are formed by satin finish or a multiplicity of axial grooves or the like, and an elastic force of a rubber roller member is generated on a substantially whole circumference of the outer peripheral surface of the core member. Therefore, an elastic force of an elastic member is liable to give rise to distribution and an error, so that it is not possible to exactly set a set torque of the torque limiter function.

SUMMARY OF THE INVENTION

It is an object of the invention to provide a passbook conveyance roller device capable of exactly setting a set torque of a torque limiter function and preventing damage to a passbook-like article when jam occurs.

In order to attain the above object, the invention provides a passbook conveyance roller device comprising a conveyance roller and a pinch roller, which are arranged to be opposed to each other, to convey a passbook-like article, and wherein the conveyance roller comprises an inner ring member connected to a drive shaft, a metallic outer ring member arranged on an outer peripheral side of the inner ring member, and torque limiter means comprising at least one elastic member fixed to one of an outer peripheral surface of the inner ring member and an inner peripheral surface of the outer ring member to give elastic forces to the other of the outer peripheral surface of the inner ring member and the inner peripheral surface of the outer ring member in a plurality of positions, which are spaced circumferentially at predetermined intervals from one another and arranged in point symmetry, the torque limiter means rotating both the inner ring member and the outer ring member through the elastic member or the like when a load torque on the outer ring member is less than a set torque set by the elastic forces of the elastic member, and generating relative slip between the other of the outer peripheral surface of the inner ring member and the inner peripheral surface of the outer ring member and the elastic member when a load torque on the outer ring member is equal to or larger than the set torque.

According to the invention, the conveyance roller is provided with an elastic member which is fixed to, for example, an outer peripheral surface of the inner ring member (or an inner peripheral surface of the outer ring member) to give elastic forces to the inner peripheral surface of the outer ring member (or the outer peripheral surface of the inner ring member) in a plurality of positions, which are spaced circumferentially at predetermined intervals from one another and arranged in point symmetry. Thereby, frictional forces are generated between the inner peripheral surface of the outer ring member (or the outer peripheral surface of the inner ring member) and the elastic member according to coefficient of friction and the elastic forces of the elastic member. In the case where a load torque on the conveyance roller (in other words, the outer ring member) is less than a set torque (more specifically, a frictional torque obtained by multiplying the frictional force by an effective radius), both the inner ring member and the outer ring member are rotated through the elastic member, etc., and in the case where a load torque on the conveyance roller is equal to or larger than the set torque, it is possible to generate relative slip between the inner peripheral surface of the outer ring member (or the outer peripheral surface of the inner ring member) and the elastic member. Accordingly, by setting a set torque of the torque limiter function larger than a load torque, for example, at the time of normal conveyance of a passbook-like article and smaller than a load torque at the time of occurrence of jam, the drive shaft and the inner ring member can be caused to idle at the time of occurrence of jam to prevent damage to the passbook-like article.

Also, according to the invention, elastic forces of the elastic member are given to the inner peripheral surface of the outer ring member (or the outer peripheral surface of the inner ring member) in a plurality of positions, which are spaced circumferentially at predetermined intervals from one another and arranged in point symmetry. Thereby, as compared with the case where an elastic force is given to, for example, the inner peripheral surface of the outer ring member (or the outer peripheral surface of the inner ring member) over a substantially whole circumference, it is possible to further exactly set the elastic forces, that is, a set torque of the torque limiter function. Also, while there is a possibility that an axis of the outer ring member gets out of position somewhat relative to an axis of the inner ring member due to, for example, a change in thickness-wise dimension of a passbook, increase and decrease in elastic forces can be complemented mutually and the sum of elastic forces can be kept by arranging positions, in which elastic forces are given, in point symmetry. Consequently, it is possible to make a set torque of the torque limiter function further stable.

Preferably, the torque limiter means comprises the elastic member fixed to the outer peripheral surface of the inner ring member to have a plurality of outer peripheral side projections, which are spaced circumferentially at predetermined intervals from one another and formed in point symmetry, press fitted into the inner peripheral surface of the outer ring member, and the torque limiter means rotates both the inner ring member and the outer ring member through the elastic member when a load torque on the outer ring member is less than a set torque set by the elastic forces of the plurality of outer peripheral side projections of the elastic member, and generates relative slip between the inner peripheral surface of the outer ring member and the outer peripheral side projections of the elastic member when a load torque on the outer ring member is equal to or larger than the set torque.

Preferably, the torque limiter means comprises the elastic member fixed to the inner peripheral surface of the outer ring member to have a plurality of inner peripheral side projections, which are spaced circumferentially at predetermined intervals from one another and formed in point symmetry, press fitted onto the outer peripheral surface of the inner ring member, and the torque limiter means rotates both the inner ring member and the outer ring member through the elastic member when a load torque on the outer ring member is less than a set torque set by the elastic forces of the plurality of inner peripheral side projections of the elastic member, and generates relative slip between the outer peripheral surface of the inner ring member and the inner peripheral side projections of the elastic member when a load torque on the outer ring member is equal to or larger than the set torque.

Preferably, the torque limiter means comprises a plurality of slide members spaced circumferentially at predetermined intervals from one another and arranged in point symmetry to be slidable on the inner peripheral surface of the outer ring member, and the plurality of elastic members fixed to the-outer peripheral surface of the inner ring member to give radially outwardly directed elastic forces to the plurality of slide members, respectively, and the torque limiter means rotates both the inner ring member and the outer ring member through the elastic members and the slide members when a load torque on the outer ring member is less than a set torque set by the elastic forces of the plurality of the elastic members, and generates relative slip between the inner peripheral surface of the outer ring member and the slide members when a load torque on the outer ring member is equal to or larger than the set torque.

Preferably, the outer ring member is provided on an outer peripheral surface thereof with a ceramic particle layer.

According to the invention, it is possible to further exactly set a set torque of the torque limiter function to prevent damage to the passbook-like article at the time of occurrence of jam.

Other objects, features and advantages of the invention will become apparent from the following description of the embodiments of the invention taken in conjunction with the accompanying drawings.

DESCRIPTION OF THE INVENTION

Embodiments of the invention will be described below with reference to the drawings.

A first embodiment of the invention will be described with reference to FIGS. 1 to 6.

Figure 1:
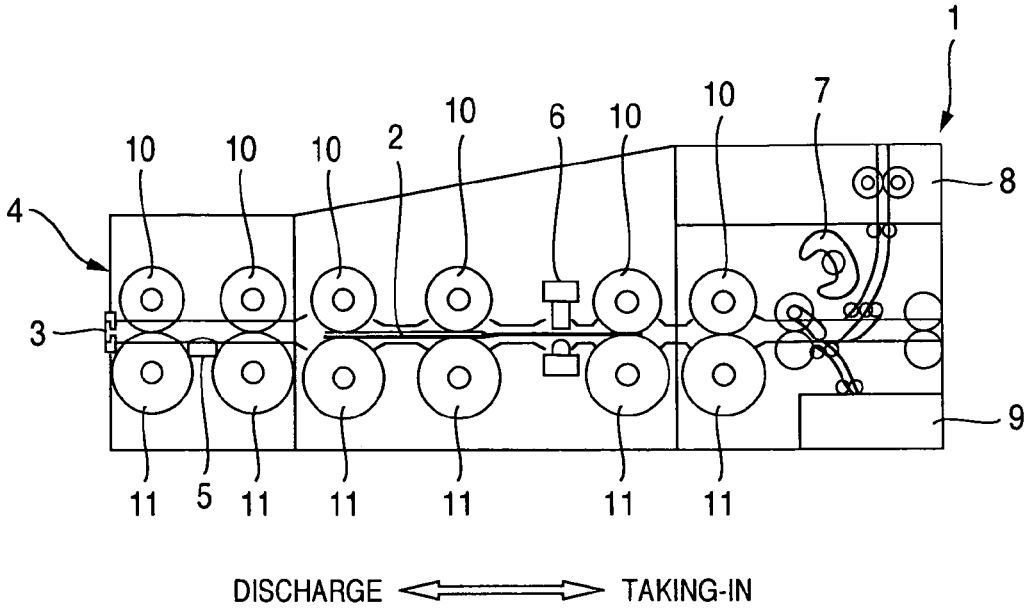
FIG. 1 is a schematic view showing a whole construction of a passbook printer, to which the invention is applied.

FIG. 1 is a schematic view showing a whole construction of a passbook printer, to which the invention is applied.

In FIG. 1, a passbook printer 1 provided in, for example, automatic teller machines and passbook handling devices comprises an entrance and leaving port 3, through which a user inserts or takes out a passbook 2, and a conveyance roller mechanism 4 provided on a passbook handling path, which extends from the entrance and leaving port 3. Also, a magnetic stripe read mechanism 5 that reads information of magnetic stripes stuck to a cover of the passbook 2, for example, an ink jet type printing mechanism 6 that makes printing on the passbook 2 on the basis of information read by the magnetic stripe read mechanism 5, and a page veerer 7 that turns over a printed page of the passbook 2 are provided on the passbook handling path in the order (the left in FIG. 1) from the entrance and leaving port 3. Also, a passbook issuing mechanism 8 that pays out a passbook 2 for new issuance onto the passbook handling path is provided above the page veerer 7, and a passbook recovery mechanism 9 that recovers a used passbook 2 on the passbook handling path is provided below the page veerer 7.

The conveyance roller mechanism 4 comprises a plurality of rows of conveyance rollers 10 arranged on a printed surface side (the upper side in FIG. 1) of a passbook 2 and of pinch rollers 11 arranged in opposition thereto, and rotates the conveyance rollers 10 and the pinch rollers 11 in mutually opposite directions to convey a passbook 2 in a taking-in direction (the right in FIG. 1) or a discharge direction (the left in FIG. 1). In addition, while the embodiment is described taking as an example a dual drive system, in which both the conveyance rollers 10 and the pinch rollers 11 are rotationally driven, a single drive system will do, in which only the conveyance rollers 10 are rotationally driven.

Figure 2:
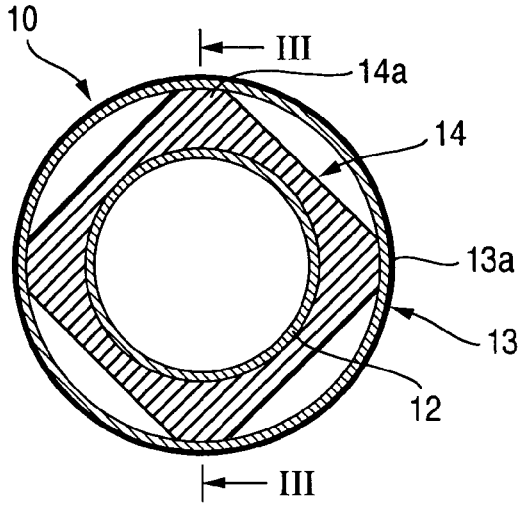
FIG. 2 is a side view showing a detailed structure of a conveyance roller, which constitutes a first embodiment of a passbook conveyance roller device according to the invention.
Figure 3:
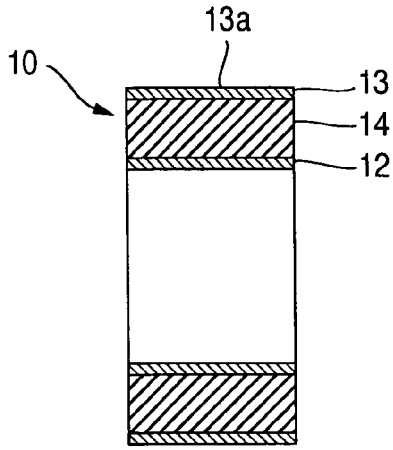
FIG. 3 is a cross sectional view of the conveyance roller taken along the line III-III in FIG. 2.

FIG. 2 is a side view showing a detailed structure of the conveyance roller 10, which constitutes an essential part of the embodiment, and FIG. 3 is a cross sectional view of the conveyance roller 10 taken along the line III-III in FIG. 2.

In FIGS. 2 and 3, the conveyance roller 10 comprises an inner ring member 12 fixed on a drive shaft (not shown), a metallic outer ring member 13 provided on an outer peripheral surface thereof with a ceramic particle layer 13*a*, and a substantially, for example, rectangular-shaped rubber member (elastic member) 14 fixed to an outer peripheral surface of the inner ring member 12 and press fitted into an inner peripheral surface of the outer ring member 13 (that is, a maximum outside diameter dimension of the rubber member 14 before being press fitted is larger than an inside diameter dimension of the outer ring member 13). In addition, the inner ring member 12 and the outer ring member 13 are structured to have the same axis.

Four projections 14*a* are formed on an outer peripheral surface of the rubber member 14 to be spaced circumferentially from one another at intervals of 90 degrees and arranged in point symmetry, and arcuate-shaped tip end surfaces of the projections 14*a* are brought into pressure contact with an inner peripheral surface of the outer ring member 13. Thereby, elastic forces on the inner peripheral surface of the outer ring member 13 are generated according to radially compressed amounts of the outer peripheral side projections 14*a* of the rubber member 14, and so frictional forces are generated between the outer peripheral side projections 14*a* of the rubber member 14 and the inner peripheral surface of the outer ring member 13 according to coefficient of friction and the elastic forces.

When a load torque on the conveyance roller 10 (in other words, the outer ring member 13) is less than a set torque (more specifically, a frictional torque obtained by multiplying the frictional force by an inner periphery radius of the outer ring member 13), both the inner ring member 12 and the outer ring member 13 are rotated through the rubber member 14, and-when a load torque on the conveyance roller 10 is equal to or larger than the set torque, relative slip is generated between the inner peripheral surface of the outer ring member 13 and the outer peripheral side projections 14*a* of the rubber member 14 (torque limiter function).

While being not shown in detail, the pinch rollers 11 comprise, for example, a rubber roller provided on a body or a surface thereof with a rubber material (hardness Hs≦60) and are given a pinch force (for example, around 5 N) toward the conveyance rollers 10 by springs.

Figure 4:
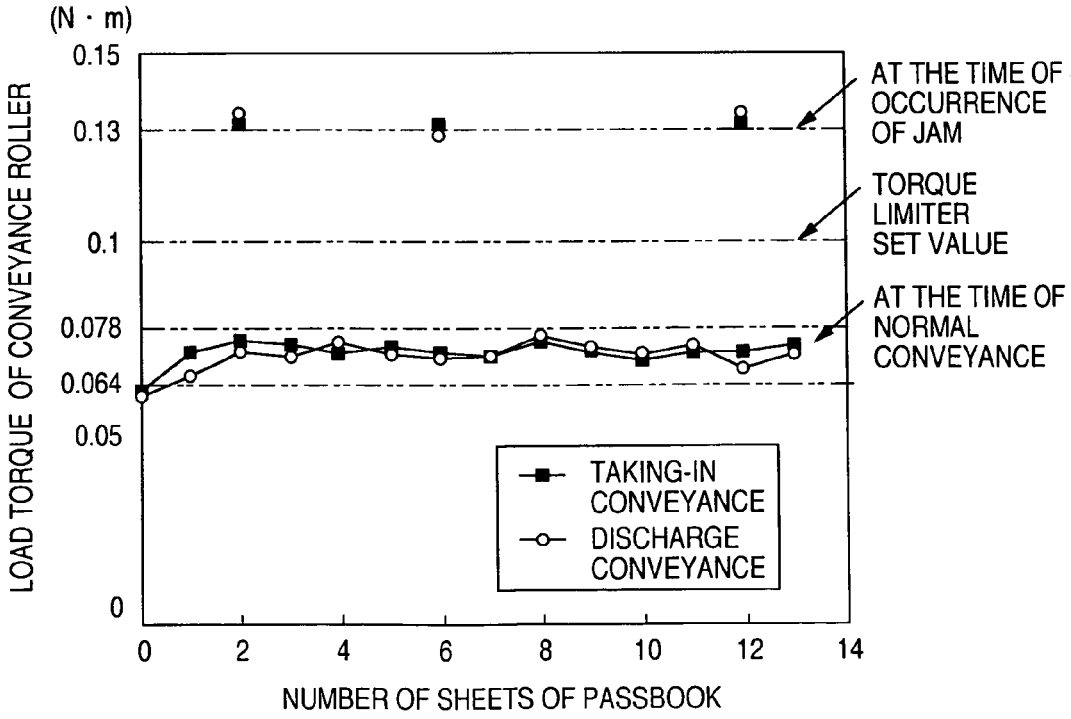
FIG. 4 is a graph representing a load torque of the conveyance roller, which constitutes the first embodiment of a passbook conveyance roller device according to the invention.

Subsequently, an explanation will be given to details of a set torque, described above, of the torque limiter function of the conveyance roller 10. FIG. 4 is a graph representing a load torque of the conveyance roller 10 measured by the inventors of the present application.

In FIG. 4, the abscissa indicates the number of sheets on a cover side or a back cover side of a passbook 2 (in FIG. 1, the right in case of conveyance in a taking-in direction and the left in case of conveyance in a discharge direction), and the ordinate indicates a load torque of the conveyance roller 10. A load torque of the conveyance roller 10 assumes about 0.6 N·m when a passbook 2 is not conveyed while the conveyance rollers 10 and the pinch rollers 11 are rotated (the number of sheets of the passbook 2 is shown as being 0 in FIG. 4), and ranges between about 0.64 and 0.78 N·m (an intermediate value is about 0.7 N·m) when a passbook 2 is normally conveyed (in FIG. 4, conveyance in the taking-in direction is indicated by circles and conveyance in the discharge direction is indicated by square marks). In the case where jam of a passbook 2 occurs, the load torque assumes about 0.13 N·m, which amounts to about 1.8 times that in normal conveyance.

According to the embodiment, a set torque of the torque limiter function of the conveyance roller 10 is set to a value (=0.1 N·m) obtained by multiplying a load torque (for example, an intermediate value of 0.71 N·m) at the time of normal conveyance by a safety factor (for example, 1.4), which value is smaller than a load torque (=0.13 N·m) when jam occurs. Thereby, relative slip is generated between the inner peripheral surface of the outer ring member 13 and the outer peripheral side projections 14*a* of the rubber member 14 the moment or just before jam of a passbook 2 occurs.

Subsequently, an explanation will be given to details of a method of designing a material and shape dimension of the rubber member 14.

The rubber member 14 (on a lower side in FIG. 1) of the conveyance roller 10 toward the pinch roller 11 is compressed by the pinch force of the pinch roller 11, so that there is a possibility that an axis of the outer ring member 13 and an axis of the inner ring member 12 get out of position somewhat. In order to achieve a decrease in out-of-position of the axes, the hardness of the rubber member 14 is preferably set to, for example, Hs≧80 to be higher than the hardness of the pinch roller 11 (Hs≦60). Also, an elastic force of the respective outer peripheral side projections 14*a* of the rubber member 14 is preferably set to 2 to 3 times the pinch force of the pinch roller 11 or more. Also, in order that an elastic force of the rubber member 14 be made 2 to 3 or more times (for example, 12N) the pinch force of the pinch roller 11, it is preferred that coating be applied to tip end surfaces of the outer peripheral side projections 14*a* of the rubber member 14, which are brought into pressure contact with the inner peripheral surface of the outer ring member 13, to set the coefficient of friction thereof low (for example, in the range of 0.2 to 0.3).

Figure 5:
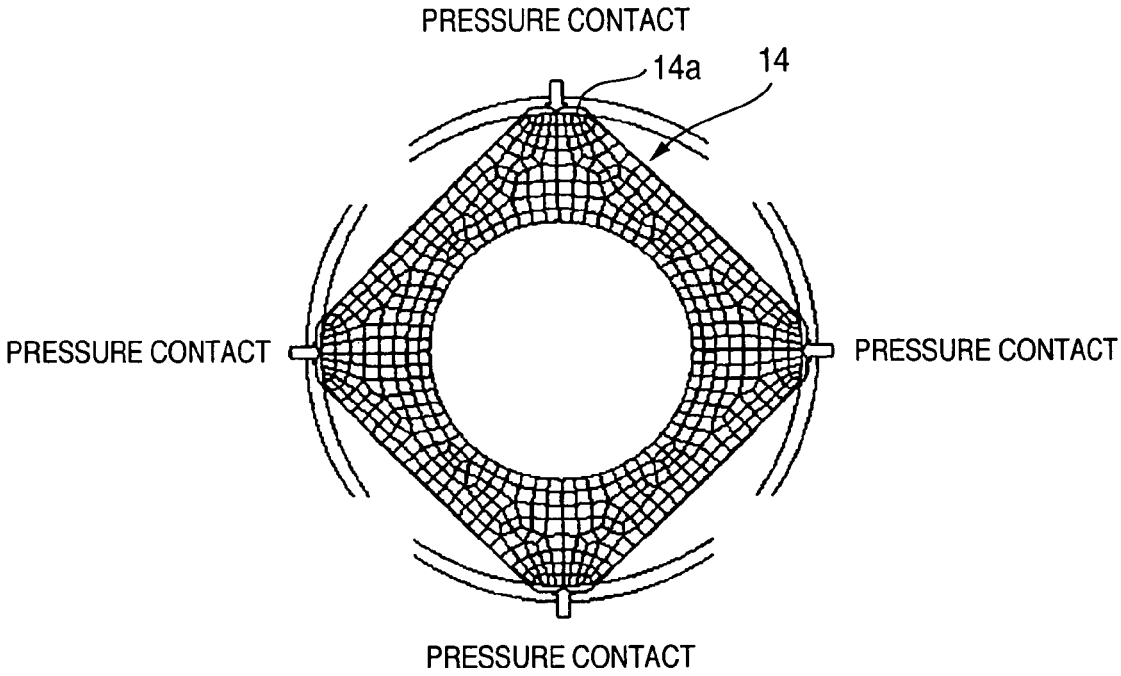
FIG. 5 is a view illustrating a computation model of a rubber member of the conveyance roller, which constitutes the first embodiment of a passbook conveyance roller device according to the invention.

Through arithmetic execution in the finite element method making use of a computation model for a rubber member 14 shown in FIG. 5, it is possible to find a radially compressed length (=0.2 mm) of the respective outer peripheral side projections 14*a* of the rubber member 14 from a set torque (=0.1 N·m) of the torque limiter function, an elastic force (=12N) of the respective outer peripheral side projections 14*a* of the rubber member 14, a coefficient of friction (=0.3) between the inner peripheral surface of the outer ring member 13 and the outer peripheral side projections 14*a* of the rubber member 14, a length (2 mm) of a contact arc of the respective outer peripheral side projections 14*a* of the rubber member 14, a contact width of the respective outer peripheral side projections 14*a* of the rubber member 14, the hardness (=80) of the rubber member 14, an inner periphery radius (=7.5 mm) of the outer ring member 13, etc. When based on results of the computation, an outer periphery radius of the rubber member 14 is made 7.7 mm for the inner periphery radius of 7.5 mm of the outer ring member 13, a set torque of the torque limiter function of the conveyance roller 10 can be set to 0.1 N·m.

Figure 6:
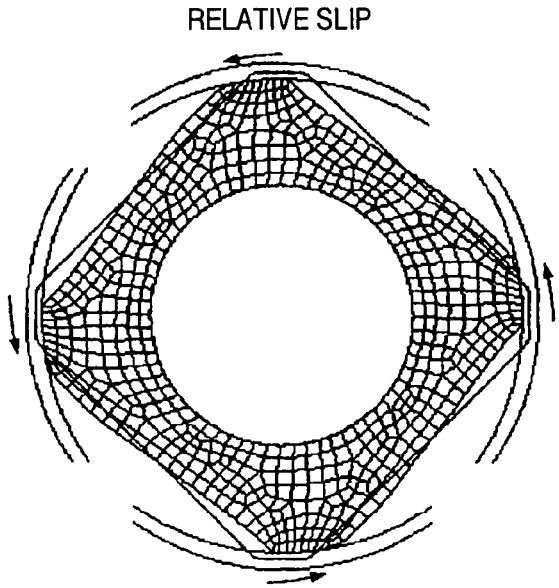
FIG. 6 is a view illustrating a computation model of a rubber member of the conveyance roller, which constitutes the first embodiment of a passbook conveyance roller device according to the invention, and a state, in which relative slip is generated between outer peripheral side projections of a rubber member and an inner peripheral surface of an outer ring member.

In addition, FIG. 6 shows a state, in which relative slip is generated between the inner peripheral surface of the outer ring member 13 and the outer peripheral side projections 14*a* of the rubber member 14, in the arithmetic execution in the finite element method.

Also, there is a possibility in the conveyance roller 10 that a radial distance between the axis of the inner ring member 12 and a passbook 2 is decreased due to out-of-position of the axis of the outer ring member 13 and a passbook 2 is decreased in conveyance speed (peripheral speed). Therefore, with the dual drive system, in which both the conveyance rollers 10 and the pinch rollers 11 are rotationally driven, the conveyance rollers 10 are preferably set to be a little large in rotational speed whereby the conveyance rollers 10 and the pinch rollers 11 are caused to agree with each other in conveyance speed.

Subsequently, an explanation will be given to an operation, function and effect of the passbook printer 1.

When a user inserts a passbook 2 into the entrance and leaving port 3 with a view to, for example, register, the passbook 2 is conveyed to a position of the magnetic stripe read mechanism 5 by the conveyance roller mechanism 4 and information (including printed line data) of magnetic stripes on the passbook 2 is read by the magnetic stripe read mechanism 5. Thereafter, the passbook 2 is conveyed to a position of the printing mechanism 6 by the conveyance roller mechanism 4 (more specifically, so as to make a printing head and a printed position of the passbook 2 agree with each other) and non-printed data are printed by the printing mechanism 6. For example, in the case where non-printed data cannot be printed on one page and in the case where it becomes necessary to print a separate page, the passbook 2 is conveyed to a position of the page veerer 7 by the conveyance roller mechanism 4, a new page is turned over by the page veerer 7, and a sensor (not shown) for detection of page code of the passbook 2 confirms whether turning-over is surely performed. Also, for example, in the case where printing up to a final page of the passbook 2 is completed and a new passbook 2 becomes necessary, the used passbook 2 is recovered by the passbook recovery mechanism 9 and a passbook 2 for new issuance is paid out by the passbook issuing mechanism 8. The passbook 2 is again conveyed to the position of the printing mechanism 6 by the conveyance roller mechanism 4 and succeedingly subjected to printing. When such printing work is completed, the passbook is discharged from the entrance and leaving port 3 by the conveyance roller mechanism 4.

There is a possibility that jam of the passbook 2 occurs by any chance for some reason in an operation, in which the passbook 2 is conveyed in the taking-in direction or in the discharge direction. Here, according to the embodiment, the conveyance rollers 10, which constitutes the conveyance roller mechanism 4, is provided with that rubber member 14, of which projections 14*a* are fixed to the outer peripheral surface of the rubber member 14 to be spaced circumferentially at predetermined intervals from one another and arranged in point symmetry and are brought into pressure contact with the inner peripheral surface of the outer ring member 13. Thereby, elastic forces on the inner peripheral surface of the outer ring member 13 are generated according to radially compressed amounts of the outer peripheral side projections 14*a* of the rubber member 14, and frictional forces are generated between the outer peripheral side projections 14*a* of the rubber member 14 and the inner peripheral surface of the outer ring member 13 according to coefficient of friction and the elastic forces. When, for example, a load torque on the conveyance roller 10 is less than a set torque (more specifically, a frictional torque obtained by multiplying the frictional force by an inner periphery radius of the outer ring member 13), both the inner ring member 12 and the outer ring member 13 are rotated through the rubber member 14, and when, for example, a load torque on the conveyance roller 10 is equal to or larger than the set torque, it is possible to generate a relative slip between the inner peripheral surface of the outer ring member 13 and the outer peripheral side projections 14*a* of the rubber member 14. Accordingly, by setting a set torque of the torque limiter function larger than a load torque, for example, at the time of normal conveyance of a passbook 2 and smaller than a load torque at the time of occurrence of jam, the drive shaft and the inner ring member 12 can be caused to idle at the time of occurrence of jam to prevent damage to the passbook 2.

Also, according to the embodiment, the outer peripheral side projections 14*a* of the rubber member 14 are formed at predetermined intervals in a circumferential direction and in point symmetry, and give elastic forces to the inner peripheral surface of the outer ring member 13 according to radially compressed amounts thereof. Thereby, as compared with the case where an elastic force is given to, for example, the inner peripheral surface of the outer ring member 13 over a substantially whole circumference, it is possible to further exactly set the elastic forces, that is, a set torque of the torque limiter function. Also, while there is a possibility that an axis of the outer ring member 13 gets out of position somewhat relative to an axis of the inner ring member 12 due to, for example, a change in thickness-wise dimension of a passbook 2, increase and decrease in elastic forces can be complemented mutually and the sum of elastic forces can be kept by arranging positions, in which elastic forces are given, in point symmetry. Consequently, it is possible to make a set torque of the torque limiter function further stable.

Also, according to the embodiment, the conveyance roller 10, which comes into contact with a printed surface of a passbook 2, comprises the outer ring member 13, which is made of a metal and provided at an outer peripheral surface thereof with the ceramic particle layer 13*a*. Thereby, it is possible to suppress transfer of a printing ink (primary transfer to the conveyance roller 10 and secondary transfer to a passbook 2). Also, the pinch roller 11, which is in non-contact with a printed surface of a passbook 2, comprises a rubber roller and is given a pinch force by a spring. Thereby, it is possible to ease an impact against a sheet number step caused by a difference between the number of sheets on a cover side of a passbook 2 and the number of sheets on a back cover side thereof and against a spine step of a stitched portion, so that it is possible to decrease out-of-position of the axis of the outer ring member 13 of the conveyance roller 10. As a result, it is possible to heighten a passbook 2 in conveyance accuracy.

Figure 7:
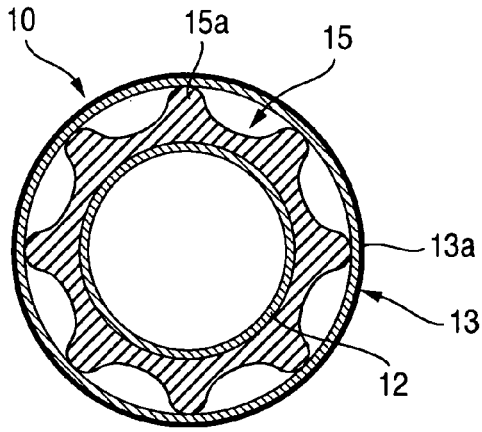
FIG. 7 is a side view showing, as a modification, a detailed structure of the conveyance roller, which constitutes a first embodiment of a passbook conveyance roller device according to the invention.

In addition, while the first embodiment has been described taking as an example that construction, in which the rubber member 14 of the conveyance roller 10 is substantially rectangular-shaped and four outer peripheral side projections 14*a* are press fitted into the inner peripheral surface of the outer ring member 13, it is not limited thereto. That is, the rubber member may be in the form of a polygonal shape such as a substantially hexagonal shape, a substantially octagonal shape, a substantially decagonal shape, etc. Also, as shown in, for example, FIG. 7, a rubber member 15 of a conveyance roller 10A may be formed with eight outer peripheral side projections 15*a*, which are spaced circumferentially at intervals of 45 degrees from one another and arranged in point symmetry, and brought into pressure contact with an inner peripheral surface of an outer ring member 13, and outer peripheral side portions except the projections 15*a* may be curved in shape to draw an arc toward an inner peripheral side. In these cases, the same effect as that in the first embodiment can be produced.

A second embodiment of the invention will be described with reference to FIG. 8. A conveyance roller according to the embodiment is embodied to comprise a rubber member fixed to an outer peripheral surface of an outer ring member and press fitted onto an outer peripheral surface of an inner ring member.

Figure 8:
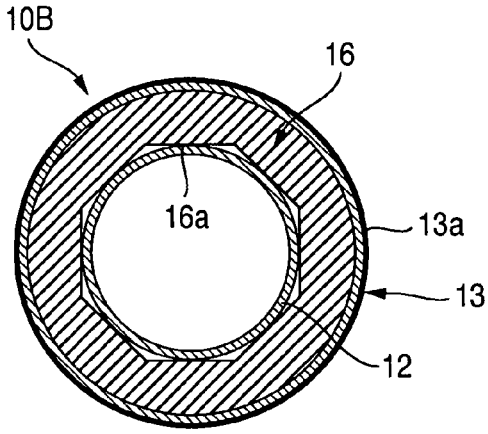
FIG. 8 is a side view showing a detailed structure of a conveyance roller, which constitutes a second embodiment of a passbook conveyance roller device according to the invention.

FIG. 8 is a side view showing a detailed structure of the conveyance roller according to the embodiment. In addition, the same parts in FIG. 8 as those in the first embodiment are denoted by the same reference numerals and an explanation therefore is appropriately omitted.

The conveyance roller 10B according to the embodiment comprises an inner ring member 12 fixed on an outer peripheral side of a drive shaft, a metallic outer ring member 13 provided on an outer peripheral surface thereof with a ceramic particle layer 13*a*, and a rubber member (elastic member) 16 fixed to an inner peripheral surface of the outer ring member 13 and press fitted onto an outer peripheral surface of the inner ring member 12 (that is, a minimum inside diameter of the rubber member 16 before being press fitted is larger than an outside diameter of the inner ring member 12). In addition, the inner ring member 12 and the outer ring member 13 are structured to have the same axis.

A plurality (eight in FIG. 8) of projections (more specifically, portions projecting toward an inner peripheral side from the same circumferential surface) 16*a* are formed on an inner peripheral side of the rubber member 16 to be spaced circumferentially at predetermined intervals (intervals of 45 degrees in FIG. 8) from one another and arranged in point symmetry, and end surfaces of the projections 16*a* are brought into pressure contact with an outer peripheral surface of the inner ring member 12. Thereby, elastic forces on the outer peripheral surface of the inner ring member 12 are generated according to radially compressed amounts of the inner peripheral side projections 16*a* of the rubber member 16, and so frictional forces are generated between the inner peripheral side projections 16*a* of the rubber member 16 and the outer peripheral surface of the inner ring member 13 according to coefficient of friction and the elastic forces.

When a load torque on the conveyance roller 10B (in other words, the outer ring member 13) is less than a set torque (more specifically, a frictional torque obtained by multiplying the frictional force by an outer periphery radius of the inner ring member 12), both the inner ring member 12 and the outer ring member 13 are rotated through the rubber member 16, and when a load torque on the conveyance roller 10B is equal to or larger than the set torque, relative slip occurs between the outer peripheral surface of the inner ring member 12 and the inner peripheral side projections 16*a* of the rubber member 16 (torque limiter function).

According to the embodiment, a set torque of the torque limiter function of the conveyance roller 10B is set to be larger than a load torque at the time of normal conveyance of a passbook 2 and smaller than a load torque at the time of occurrence of jam. Thereby, like the first embodiment, the drive shaft and the inner ring member 12 can be caused to idle at the time of occurrence of jam to prevent damage to the passbook 2. Since the inner peripheral side projections 16*a* of the rubber member 16 are formed to be spaced circumferentially at predetermined intervals from one another and arranged in point symmetry, and elastic forces are given to the outer peripheral surface of the inner ring member 12 radially compressed amounts thereof, it is possible like the first embodiment to further exactly set a set torque of the torque limiter function.

A third embodiment of the invention will be described with reference to FIGS. 9 and 10. A conveyance roller according to the embodiment is embodied to comprise a plurality of slide members slidable on an inner peripheral surface of an outer ring member and a plurality of spring members fixed to an inner peripheral surface of an inner ring member to give radially outwardly directed elastic forces to the plurality of slide members.

Figure 9:
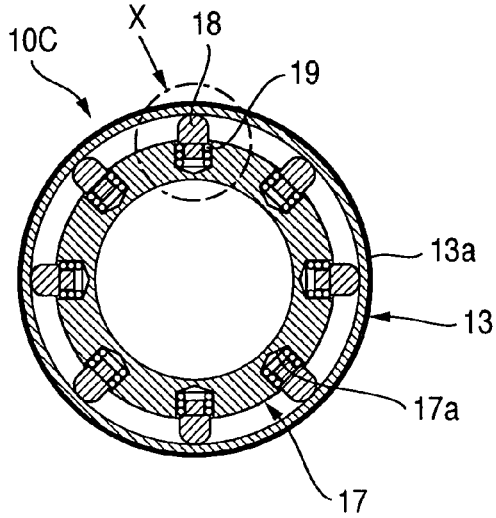
FIG. 9 is a side, cross sectional view showing a detailed structure of a conveyance roller, which constitutes a third embodiment of a passbook conveyance roller device according to the invention.
Figure 10:
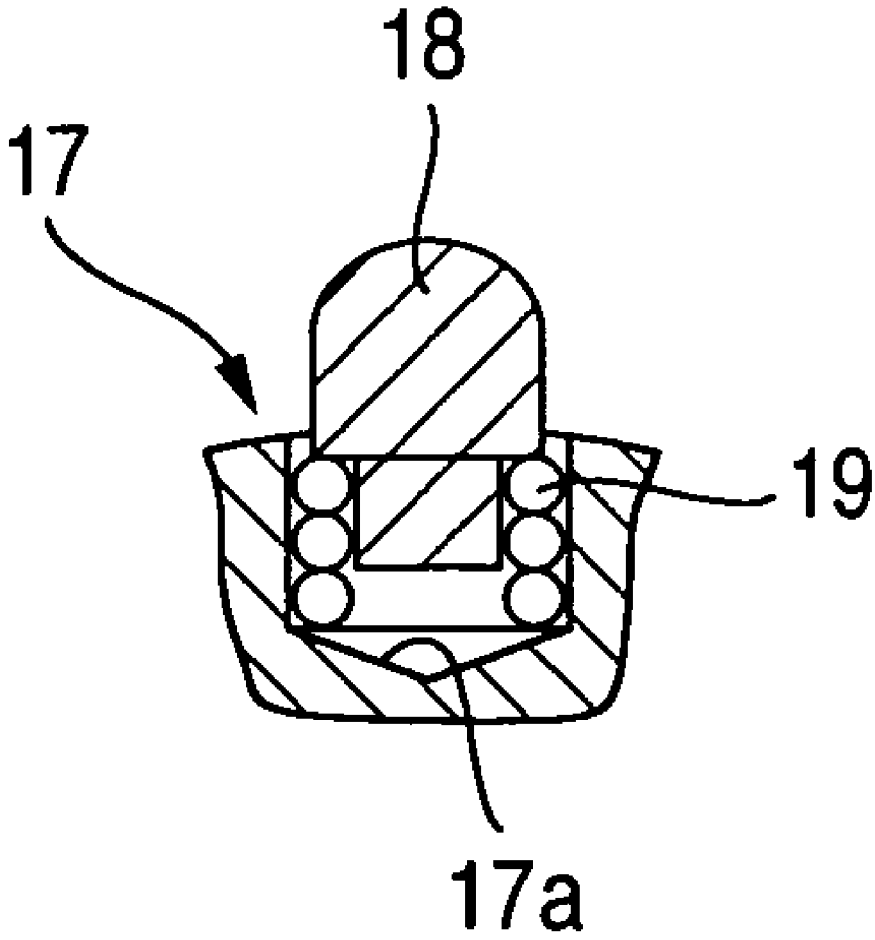
FIG. 10 is a side, cross sectional view showing, in a partially enlarged scale, a X part in FIG. 9.

FIG. 9 is a side, cross sectional view showing a detailed structure of the conveyance roller according to the embodiment, and FIG. 10 is a side, cross sectional view showing, in a partially enlarged scale, X part in FIG. 9. In addition, the same parts in FIGS. 9 and 10 as those in the first and second embodiments are denoted by the same reference numerals and an explanation therefore is appropriately omitted.

The conveyance roller 10C according to the embodiment comprises an inner ring member 17 fixed on an outer peripheral side of a drive shaft, a metallic outer ring member 13 provided on an outer peripheral surface thereof with a ceramic particle layer 13*a*, a plurality of slide members 18 slidable on an inner peripheral surface of the outer ring member 13, and a plurality of spring members (elastic members) 19 fixed to an outer peripheral side of the inner ring member 17 to give radially outwardly directed elastic forces to the plurality of slide members 18. In addition, the inner ring member 17 and the outer ring member 13 are structured to have the same axis.

Accommodation grooves 17*a* for accommodation of respective combinations of the slide member 18 and the spring member 19 are formed in a plurality (eight in FIG. 9) of positions, which are spaced circumferentially at predetermined intervals (intervals of 45 degrees in FIG. 9) from one another and arranged in point symmetry. Elastic forces of the spring members 19 cause arcuate-shaped slide surfaces of the slide members 18 to brought into pressure contact with the inner peripheral surface of the outer ring member 13, so that frictional forces are generated between the slide surfaces of the slide members 18 and the inner peripheral surface of the outer ring member 13 according to coefficient of friction and the push forces (in other words, elastic forces of the spring members 19).

When a load torque on the conveyance roller 10C (in other words, the outer ring member 13) is less than a set torque (more specifically, a frictional torque obtained by multiplying the frictional force by an inner periphery radius of the outer ring member 13), both the inner ring member 17 and the outer ring member 13 are rotated through the spring members 19 and the slide members 18, and when a load torque on the conveyance roller 10C is equal to or larger than the set torque, relative slip occurs between the inner peripheral surface of the outer ring member 13 and the slide surfaces of the slide members 18 (torque limiter function).

According to the embodiment, a set torque of the torque limiter function of the conveyance roller 10C is set to be larger than a load torque at the time of normal conveyance of a passbook 2 and smaller than a load torque at the time of occurrence of jam. Thereby, like the first and second embodiments, the drive shaft and the inner ring member 17 can be caused to idle at the time of occurrence of jam to prevent damage to the passbook 2. Also, since the spring members 19 and the slide members 18 are arranged to be spaced circumferentially at predetermined intervals from one another and arranged in point symmetry, and push forces (elastic forces) are given to the inner peripheral surface of the outer ring member 13, it is possible like the first and second embodiments to further exactly set a set torque of the torque limiter function.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A passbook conveyance roller device comprising a conveyance roller and a pinch roller, which are arranged to be opposed to each other and are arranged to convey a printed paper containing article, and wherein the conveyance roller comprises an inner ring member connected to a drive shaft, a metallic outer ring member arranged on an outer peripheral side of the inner ring member, and torque limiter means comprising at least one elastic member fixed to one of an outer peripheral surface of the inner ring member and an inner peripheral surface of the outer ring member to give elastic forces to the other of the outer peripheral surface of the inner ring member and the inner peripheral surface of the outer ring member in a plurality of positions, which are spaced circumferentially at predetermined intervals from one another and arranged in point symmetry, the torque limiter means rotating both the inner ring member and the outer ring member through the elastic member when a load torque on the outer ring member is less than a set torque set by the elastic forces of the elastic member, and generating an idle condition between the elastic member and the other of the outer peripheral surface of the inner ring member and the inner peripheral surface of the outer ring member to prevent damage to the printed paper article when a load torque on the outer ring member is equal to or larger than the set torque at a time of occurrence of a jam.

2. A passbook conveyance roller device comprising a conveyance roller and a pinch roller, which are arranged to be opposed to each other, to convey a printed paper containing article, and wherein the conveyance roller comprises an inner ring member connected to a drive shaft, a metallic outer ring member arranged on an outer peripheral side of the inner ring member, and torque limiter means comprising at least one elastic member fixed to one of an outer peripheral surface of the inner ring member and an inner peripheral surface of the outer ring member to give elastic forces to the other of the outer peripheral surface of the inner ring member and the inner peripheral surface of the outer ring member in a plurality of positions, which are spaced circumferentially at predetermined intervals from one another and arranged in point symmetry, the torque limiter means rotating both the inner ring member and the outer ring member through the elastic member when a load torque on the outer ring member is less than a set torque set by the elastic forces of the elastic member, and generating relative slip between the elastic member and the other of the outer peripheral surface of the inner ring member and the inner peripheral surface of the outer ring member when a load torque on the outer ring member is equal to or larger than the set torque, wherein the torque limiter means comprises the elastic member fixed to the outer peripheral surface of the inner ring member to have a plurality of outer peripheral side projections, which are spaced circumferentially at predetermined intervals from one another and formed in point symmetry, press fitted into the inner peripheral surface of the outer ring member, the torque limiter means rotating both the inner ring member and the outer ring member through the elastic member when a load torque on the outer ring member is less than a set torque set by the elastic forces of the plurality of outer peripheral side projections of the elastic member, and generating relative slip between the inner peripheral surface of the outer ring member and the outer peripheral side projections of the elastic member when a load torque on the outer ring member is equal to or larger than the set torque.

3. A passbook conveyance roller device comprising a conveyance roller and a pinch roller, which are arranged to be opposed to each other, to convey a printed paper containing article, and wherein the conveyance roller comprises an inner ring member connected to a drive shaft, a metallic outer ring member arranged on an outer peripheral side of the inner ring member, and torque limiter means comprising at least one elastic member fixed to one of an outer peripheral surface of the inner ring member and an inner peripheral surface of the outer ring member to give elastic forces to the other of the outer peripheral surface of the inner ring member and the inner peripheral surface of the outer ring member in a plurality of positions, which are spaced circumferentially at predetermined intervals from one another and arranged in point symmetry, the torque limiter means rotating both the inner ring member and the outer ring member through the elastic member when a load torque on the outer ring member is less than a set torque set by the elastic forces of the elastic member, and generating relative slip between the elastic member and the other of the outer peripheral surface of the inner ring member and the inner peripheral surface of the outer ring member when a load torque on the outer ring member is equal to or larger than the set torque, wherein the torque limiter means comprises the elastic member fixed to the inner peripheral surface of the outer ring member to have a plurality of inner peripheral side projections, which are spaced circumferentially at predetermined intervals from one another and formed in point symmetry, press fitted onto the outer peripheral surface of the inner ring member, the torque limiter means rotating both the inner ring member and the outer ring member through the elastic member when a load torque on the outer ring member is less than a set torque set by the elastic forces of the plurality of inner peripheral side projections of the elastic member, and generating relative slip between the outer peripheral surface of the inner ring member and the inner peripheral side projections of the elastic member when a load torque on the outer ring member is equal to or larger than the set torque.

4. A passbook conveyance roller device comprising a conveyance roller and a pinch roller, which are arranged to be opposed to each other, to convey a printed paper containing article, and wherein the conveyance roller comprises an inner ring member connected to a drive shaft, a metallic outer ring member arranged on an outer peripheral side of the inner ring member, and torque limiter means comprising at least one elastic member fixed to one of an outer peripheral surface of the inner ring member and an inner peripheral surface of the outer ring member to give elastic forces to the other of the outer peripheral surface of the inner ring member and the inner peripheral surface of the outer ring member in a plurality of positions, which are spaced circumferentially at predetermined intervals from one another and arranged in point symmetry, the torque limiter means rotating both the inner ring member and the outer ring member through the elastic member when a load torque on the outer ring member is less than a set torque set by the elastic forces of the elastic member, and generating relative slip between the elastic member and the other of the outer peripheral surface of the inner ring member and the inner peripheral surface of the outer ring member when a load torque on the outer ring member is equal to or larger than the set torque, wherein the torque limiter means comprises a plurality of slide members spaced circumferentially at predetermined intervals from one another and arranged in point symmetry to be slidable on the inner peripheral surface of the outer ring member, and the plurality of elastic members fixed to the outer peripheral surface of the inner ring member to give radially outwardly directed elastic forces to the plurality of slide members, respectively, the torque limiter means rotating both the inner ring member and the outer ring member through the elastic members and the slide members when a load torque on the outer ring member is less than a set torque set by the elastic forces of the plurality of the elastic members, and generating relative slip between the inner peripheral surface of the outer ring member and the slide members when a load torque on the outer ring member is equal to or larger than the set torque.

5. A passbook conveyance roller device according to any one of claims 1 to 4, wherein the outer ring member is provided on an outer peripheral surface thereof with a ceramic particle layer.

6. A passbook conveyance roller device according to any one of claims 1 to 4, wherein the printed paper containing article is a passbook.

* * * * *